United States Patent [19]

Seifert

[11] 4,318,428

[45] Mar. 9, 1982

[54] WARP BEAM

[75] Inventor: Everhard Seifert, Rickenbach, Fed. Rep. of Germany

[73] Assignee: Sulzer Brothers Ltd., Winterthur, Switzerland

[21] Appl. No.: 133,592

[22] Filed: Mar. 24, 1980

[30] Foreign Application Priority Data

Mar. 28, 1979 [CH] Switzerland ..... 2872/79

[51] Int. Cl.[3] ..... D03D 49/00; D02H 13/32

[52] U.S. Cl. ..... 139/97; 242/129.5; 242/117

[58] Field of Search ..... 242/117, 129.5, 129.6; 28/172; 139/97, 100, 35, 1 R, 429, 439

[56] References Cited

U.S. PATENT DOCUMENTS 1,095,881 5/1914 Keck ..... 242/117

3,332,664 7/1967 Luketa ..... 242/117

3,572,599 3/1971 Hilmer ..... 242/117

FOREIGN PATENT DOCUMENTS 1053426 3/1959 Czechoslovakia ..... 139/97

940086 5/1948 France ..... 139/97

*Primary Examiner*—Henry Jaudon

*Attorney, Agent, or Firm*—Kenyon & Kenyon

[57] ABSTRACT

The warp beam is constructed with a hollow tube on which flanges can be symmetrically mounted as well as with a tubular extension at one end to permit asymmetric mounting in the bearings of a weaving machine. The warp beam is shaftless and the extension element has a slightly greater diameter than the diameter of the warp beam tube so as to render the warp beam more rigid. The rigidity of the warp beam reduces distortions and vibrations of the warp beam during weaving.

12 Claims, 2 Drawing Figures

WARP BEAM

Figure 1:
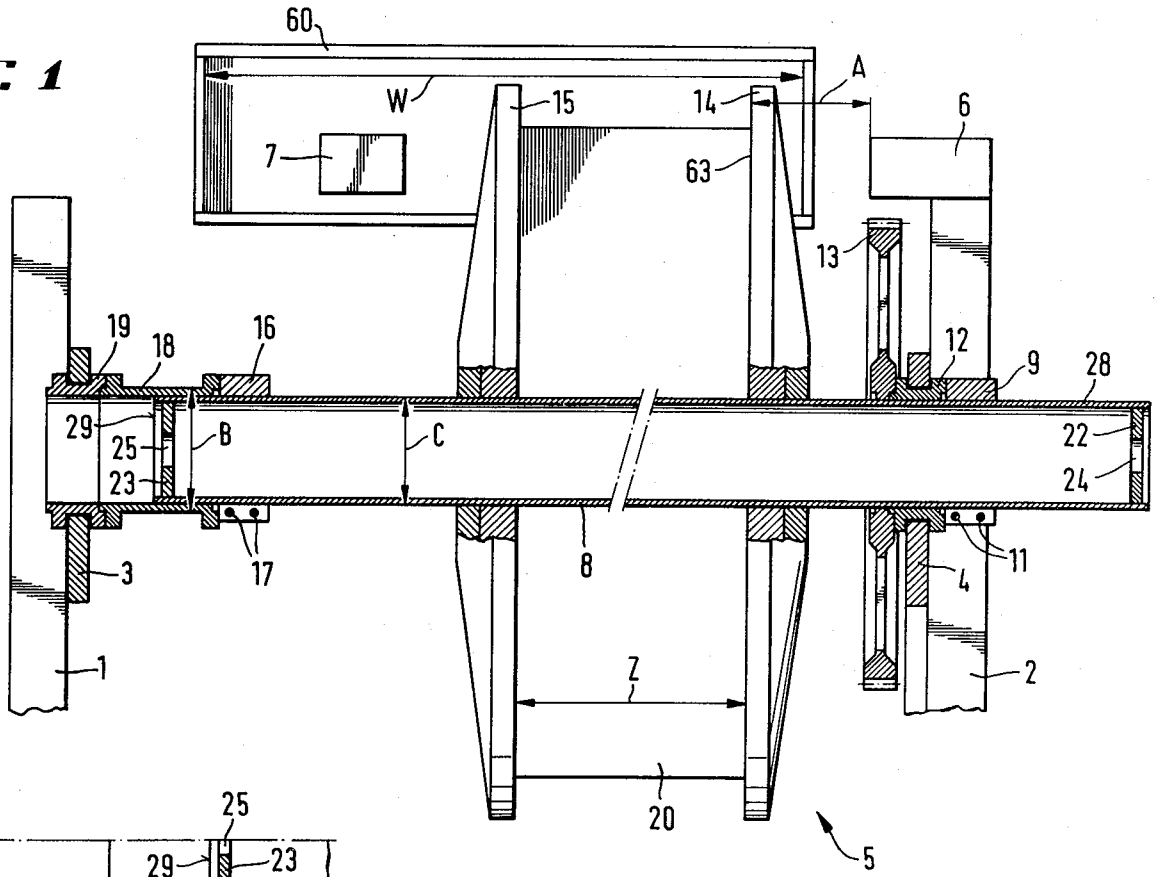

This invention relates to a warp beam and, particularly, to a warp beam for a weaving machine.

As is known, warp beams have been mounted in various manners at the end of a weaving machine in order to supply warp threads to the machine for weaving into cloth. In one conventional arrangement, as described in Swiss Pat. No. 360,035, the warp beam which is to be mounted in two outer bearings of a weaving machine has a tube, a shaft of square cross-sectional shape which is introduced into the tube and a flange which is fitted to the shaft at one end of the warp beam. The flange, in turn, carries a co-rotating bearing part which is rotatably mounted in an associated stationary bearing on the weaving machine. The square shaft and the flange secured thereto enable the warp beam to be introduced, for example, for a reduced warp width, to the outer warp beam bearing of the weaving machine such that the weft-side edge of the warp or of the cloth is always disposed at a very short distance from a picking mechanism of the machine irrespective of the warp width or weaving width.

However, the free part of the square shaft of the warp beam which forms an extension of the warp beam on the side remote from the picking mechanism, where such part fits into the warp beam bearing on that side, may experience a relatively severe distortion due to the weight of the warp beam or because of forces which occur during weaving, particularly as a result of beating-up, and which have corresponding vibrations. This can be a detriment to weaving. For example, errors such as an uneven weft density or the like, may occur in the cloth particularly on a catching half of the cloth. Also, the warp yarns, particularly those near the catching mechanism, are likely to experience a heavier tension than the warp yarns near the picking mechanism.

Accordingly, it is an object of the invention to provide an improved warp beam for weaving machines.

It is another object of the invention to eliminate the need for a warp beam shaft.

It is another object of the invention to avoid sagging of a warp beam on a catching side of a weaving machine when the warp beam is asymmetrically mounted.

It is another object of the invention to provide a weaving machine with a very heavy warp beam.

It is another object of the invention to obviate vibrations in a warp beam during weaving.

It is another object of the invention to reduce defects in a cloth woven in a weaving machine due to distortions and vibrations of a warp beam mounted on the machine.

Briefly, the invention provides a warp beam which is comprised of an elongated tube, and at least one tubular extension mounted on one end of the tube. In addition, a bearing member is secured to the tubular extension for mounting of the warp beam in a bearing of a weaving machine.

The tubular extension has an outer diameter substantially equal to the outer diameter of the tube so as to form a rigid structure and is secured to the tube via a clamping flange. Because of the tubular extension, the elongated tube can be hollow and shaftless.

By providing the tubular extension on the warp beam tube, the warp beam can be asymmetrically disposed on a weaving machine. Thus, the warp beam can be extended, for example in the case of a reduced warp width with an asymmetrical arrangement of the warp beam.

Because the tubular extension has a relatively large diameter, the extension can be more rigid than the more conventional warp beam shaft. Consequently, sagging of a warp beam shaft as is conventionally experienced on the catching side of a weaving machine is eliminated. No additional support is required in the region of the extension of the warp beam. Thus, very heavy warp beams weighing, for example 2,000 kilograms or more, can be used.

The warp beam can thus be mounted in a stable manner so that vibrations are obviated. Thus, the warp threads experience the same tension across the width of the weaving machine so that mistakes in cloths, such as are conventionally caused by distortions and vibrations of the warp beam on one side, can be avoided.

Figure 2:
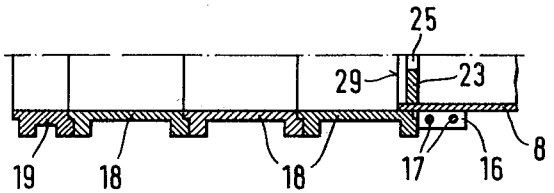

These and other objects and advantages of the invention will become more apparent from the following detailed description and appended claims taken in conjunction with the accompanying drawings in which:

FIG. 1 illustrates a part diagrammatic view of a warp beam constructed in accordance with the invention on a weaving machine; and FIG. 2 illustrates a part cross-sectional view of a modified warp beam extension in accordance with the invention.

Referring to FIG. 1, a weaving machine of conventional structure has a frame with a warp beam end, a pair of uprights 1,2 located along the sides, and a pair of bearings 3,4 which are fixedly disposed on the uprights 1,2 and which can be opened in conventional manner for the inroduction of a warp beam 5. The machine also has a suitable picking mechanism 6 on one side for inserting a weft thread and a suitable catching mechanism 7 on an opposite side.

The warp beam 5 is mounted on the warp beam end of the machine and includes a tube 8 of hollow elongated shape and of a predetermined outer diameter C. As indicated, the tube 8 is journalled in the respective bearings 3,4. To this end, one end of the tube 8, i.e. the picking mechanism end, has a clamping flange 9 secured thereon by means of a pair of tangential screws 11. This clamping flange 9, in turn, secures a bearing member 12 on the tube 8 in fixed relation. This bearing member 12 is, in turn, journalled in the stationary bearing 4.

As shown, a gear 13 is secured to the bearing member 12 in fixed relation to the tube 8 and serves for the pay-off of the warp, i.e. for driving the warp beam 5.

The opposite end of the tube 8, i.e. the catching end, has a clamping flange 16 secured thereon via a pair of tangential screws 17. This clamping flange 16, in turn, secures a tubular extension 18 onto and over the catching end 29 of the tube 8. A bearing member 19 is also secured to the tubular extension 18 and is journalled in the stationary bearing 3.

As illustrated, the warp beam has a pair of flanges 14,15 mounted on the tube 8 in conventional manner intermediately of the ends to form lateral boundaries for a plurality of warp windings 20. As indicated, the windings are disposed over a width Z and the flanges 14,15 are disposed symmetrically of the tube 8.

The tube 8 is closed at both ends by means of disks 22,23 formed with bores 24,25. These bores are unencumbered, i.e. no warp beam shaft is required in operation. Alternatively, the disks 22,23 can be formed without the bores 24,25.

As illustrated, the warp width Z does not correspond to the maximum weaving width W of the weaving machine, which weaving width W is limited by the width of the heddles 60 of the machine. Thus, in mounting the warp beam 5, the tube 8 is passed through the picking side bearing 4 so that the edge of the windings 20 is spaced a distance A from the picking mechanism 6. Consequently, the catching end 29 of the tube 8 is disposed inside of the upright 1 and the stationary bearing 3. However, the tubular extension 18 extends the tube 8 towards the catching side so as to journal the beam 5 within the bearing 3. Thus, the windings 20 can be mounted symmetrically of the tube 8 while being asymmetric to the heddles 60 of the weaving machine.

The tubular extension 18 has substantially the same diameter B as the tube 8. Because of this relatively large diameter B, the extension 18 is relatively rigid. Hence, distortions and vibrations of the warp beam 5 during operation can be reduced considerably.

Referring to FIG. 2, two or more extensions 18, e.g. three as viewed, can be disposed in contiguous relationship to one another so that the warp beam 5 can be shifted further to the right as viewed in FIG. 1.

Further, one or more tubular extensions 18 can be used in multiple element warp beams. An extension 18 can also be relatively short axially so as to be of substantially annular shape. As a rule, the diameter B of the extension 18 is only slightly greater than the diameter C of the tube 8. However, the diameter B can also be considerably greater than the diameter C.

What is claimed is:

1. A warp beam comprising
an elongated tube;
a pair of flanges mounted on said tube to form lateral boundaries for a plurality of warp windings; and
at least one tubular extension mounted onto and over one end of said tube.

2. A warp beam as set forth in claim 1 which further comprises a bearing member secured to said tubular extension for mounting of the warp beam in a bearing of a weaving machine.

3. A warp beam as set forth in claim 1 which further comprises a clamping flange securing said tubular extension to said tube.

4. A warp beam as set forth in claim 3 wherein said tubular extension has an outer diameter substantially equal to an outer diameter of said tube.

5. A warp beam as set forth in claim 1 wherein said tube is hollow and shaftless.

6. A warp beam comprising
an elongaated tube having a pair of ends;
a first bearing member mounted on one end of said tube for mounting of the warp beam in a bearing of a weaving machine;
at least one tubular extension mounted onto and over an opposite end of said tube; and
a second bearing member secured to said tubular extension for mounting of the warp beam in a second bearing of a weaving machine.

7. A warp beam as set forth in claim 6 which further comprises a pair of flanges mounted symmetrically on said tube to form lateral boundaries for a plurality of warp windings.

8. In combination,
a weaving machine having a warp beam end, a picking mechanism on one side for inserting a weft thread, a catching mechanism on an opposite side, and a pair of bearings at opposite sides of said warp beam end; and
a warp beam mounted on said warp beam end of said machine, said warp beam including a tube having one end journalled in one of said bearings on said picking mechanism side of said machine and a tubular extension mounted on an opposite end of said tube and journalled in the other of said bearings on said catching mechanism side of said machine.

9. The combination as set forth in claim 8 wherein said warp beam has a first bearing member mounted on said one end of said tube and journalled in said one bearing and a second bearing member secured to said tubular extension and journalled in said other bearing.

10. The combination as set forth in claim 9 wherein said warp beam has a pair of flanges mounted symmetrically on said tube to form lateral boundaries for a plurality of warp windings.

11. A warp beam comprising
an elongated tube;
a pair of flanges mounted on said tube to form lateral boundaries for a plurality of warp windings;
at least one tubular extension mounted on one end of said tube; and
a clamping flange securing said tubular extension to said tube.

12. A warp beam comprising
an elongated hollow and shaftless tube;
a pair of flanges mounted on said tube to form lateral boundaries for a plurality of warp windings; and
at least one tubular extension mounted on one end of said tube.

* * * * *